US005907270A

United States Patent [19]

Branston et al.

[11] Patent Number: 5,907,270

[45] Date of Patent: May 25, 1999

[54] CURRENT-LIMITING SWITCH

[75] Inventors: David Walter Branston, Effeltrich; Wilfried Jaehner, Nürnberg; Fritz Pohl, Hemhofen, all of Germany

[73] Assignee: Siemens Aktiengesellschaft, Munich, Germany

[21] Appl. No.: 08/849,941

[22] PCT Filed: Dec. 15, 1995

[86] PCT No.: PCT/DE95/01799

§ 371 Date: Jun. 20, 1997

§ 102(e) Date: Jun. 20, 1997

[87] PCT Pub. No.: WO96/19817

PCT Pub. Date: Jun. 27, 1996

[30] Foreign Application Priority Data

Dec. 22, 1994 [DE] Germany ..... 44 46 045

[51] Int. Cl.[6] ..... H01H 31/00; H01H 85/00; H01H 33/02; H01C 13/00

[52] U.S. Cl. ..... 337/12; 337/17; 337/19; 337/31; 337/34; 337/4; 337/5; 338/67; 200/61.08; 218/154; 218/158

[58] Field of Search ..... 337/12, 142, 290–298, 337/114–122, 401–417, 4, 5; 338/22 SD, 20, 22 R, 67; 218/1, 117, 154–158; 200/61.08

[56] References Cited

U.S. PATENT DOCUMENTS

| | | | |
|---|---|---|---|
| 3,227,983 | 1/1966 | Braun et al. . | |
| 3,356,808 | 12/1967 | Dakin et al. | 218/158 X |
| 3,743,993 | 7/1973 | Alley et al. . | |
| 3,848,213 | 11/1974 | Schmitt | 337/107 |
| 3,987,388 | 10/1976 | Niemeyer | 337/114 |
| 4,419,650 | 12/1983 | John | 337/119 |
| 4,481,498 | 11/1984 | Mc Tavish et al. | 338/20 |
| 4,510,480 | 4/1985 | Rossi et al. | 337/117 |
| 4,542,365 | 9/1985 | Mc Tavish et al. | 338/20 |
| 4,549,161 | 10/1985 | Mc Tavish et al. | 338/20 |
| 4,550,301 | 10/1985 | Mc Tavish et al. | 338/20 |
| 4,642,136 | 2/1987 | Fukushima et al. | 338/22 R X |

FOREIGN PATENT DOCUMENTS

| | | |
|---|---|---|
| 1812678 | 6/1960 | Germany . |
| 1763145 | 8/1972 | Germany . |
| 2701414 | 7/1978 | Germany . |
| 2439066 | 6/1982 | Germany . |
| 4230848 | 12/1993 | Germany . |
| 95/03619 | 2/1995 | WIPO . |

*Primary Examiner*—Leo P. Picard
*Assistant Examiner*—Anatoly Vortman
*Attorney, Agent, or Firm*—Kenyon & Kenyon

[57] ABSTRACT

A current-limiting switch, with current connections and contacts, at least one of which is movable, having an associated drive, for opening the moving contact when a predefined electric current intensity is exceeded, are provided. The drive is a thermoelectric drive where a disk-shaped resistor body is present, in a closed housing made of insulating material, for high-intensity discharges, plurality of resistor bodies and associated electrode disks, acting as contacts, are connected electrically in parallel and mechanically in series in the housing made of an insulating material (1). This results in increased switching capacity with compact design.

9 Claims, 2 Drawing Sheets

CURRENT-LIMITING SWITCH

FIELD OF THE INVENTION

The present invention concerns a current-limiting switch with current connections and contacts, at least one of which is movable, having an associated drive for opening the movable contact when a predefined electric current intensity is exceeded, the drive being a thermoelectric drive, where, in a closed housing made of insulating material, at least one disk-shaped resistor body is present between the contacts for high-intensity discharges.

BACKGROUND INFORMATION

In the international patent application WO-A-95/03619, a switch of the aforementioned type is proposed for us as a limiter. A large-surface resistor body, with an electrical resistivity that is considerably higher than that of a metal, is used to prevent localized fusing of the electrodes n the case of a short-circuit shutoff due to the plane propagation of the current flow; uniform heating of a gas volume present in the closed housing made of insulated material is also favored by the high-intensity discharges on the resistor material.

Switching with thermoelectric drive, which is the principle of the above-described switch, is therefore based on heating suitable resistor elements, such as disks made of carbon black-filled polyethylene, instantaneously at the contacting boundary surfaces and producing a high-pressure gas blanket through material decomposition that releases mechanical energy through a piston in the case of a short circuit. The thermal and electrical properties of the best resistor materials currently available require that the nominal current be limited to a current density of approximately 1 A/cm$^2$ at a contact pressure of approximately 100 N/cm$^2$ for AC3 operation. Electrodes and resistor disks of approximately 18 cm diameter and contact forces of approximately 25 kN would be needed to extend the above-mentioned switching principle to nominal currents of 250 A, for example.

This means that the mechanical design of a thermoelectric switch suitable for higher nominal currents must be extremely sturdy, with it individual components having a relatively high weight. However, the necessity of moving large electrode weights makes achieving a sufficient speed of the thermoelectric drive difficult.

SUMMARY OF THE INVENTION

An object of the present invention is therefore to provide a switch with a thermoelectric drive that can be used for low-voltage networks with nominal currents of several hundreds amperes. In particular, higher amounts of mechanical energy and larger drive paths are to be achieved, while a compact design is to be preserved.

This object is achieved according to the present invention by connecting, in a housing made of insulating material, a plurality of resistor bodies and associated electrode disks acting as contacts electrically in parallel and mechanically in series. In particular, the housing made of insulating material forms a cylindrical switching chamber inside and has a stack of a plurality of, for example, six, electrodes acting as movable and fixed contacts and a number diminished by one, for example five resistor bodies between said contacts, both of which are arranged in alternating layers one on top of the other.

The present invention allows, for example, the contact force to be reduced to approximately 5 kN and the diameter to be reduced to 8 cm compared to the above-mentioned values in an embodiment for a nominal current of 250 A, for example. The effective drive path increases approximately 5-fold, so that a stroke of 5 to 10 mm can easily be achieved.

One particular advantage of the present invention is that the electrodes can be designed not for mechanical strength but for electrical conductivity and the required heat removal, which results in considerable weight savings. In particular, a weight reduction in the proportion of 11:1 is achieved in comparison with the aforementioned example.

DETAILED DESCRIPTION

Figure 1:
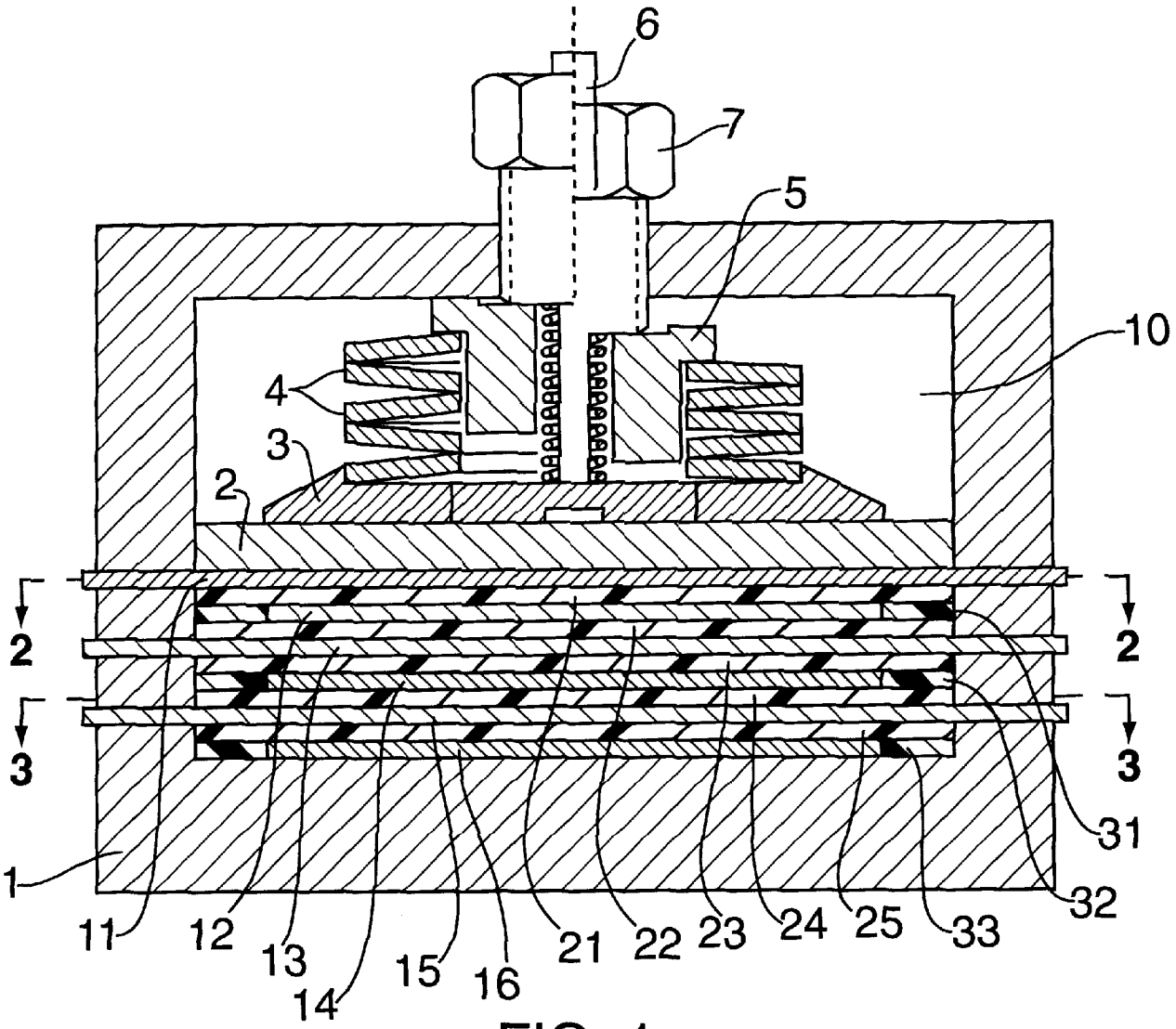
FIG. 1 schematically shows the cross-section of an electrothermal switch.

FIG. 1 shows a housing 1 made of insulating material, closed to the outside. Housing 1 made of insulating material has the shape of a hollow cylinder and has an approximately cylindrical switching chamber 10 inside. In switching chamber 10, copper electrodes 11 through 16, silver-plated on the bottom, are arranged alternatingly with disk-shaped resistor elements 21 through 25 and, on the edges, insulating material elements 31 through 33, which will be described in more detail later. Resistor elements 21 through 25 are made of a material with high resistivity compared to a metal, for example, with a specific resistivity of 0.1 to 1 Ωcm. Such a material can be, for example, polyethylene with a high carbon black content (approx. 50%).

An insulating disk 2 for a platen 3 is placed on the stack made of alternating electrodes 11 through 16 and disk-shaped resistor elements 21 through 25, with insulating disk 2 filling the diameter of switching chamber 10 and being guided slidingly along the edges. Platen 3, acted upon by pressure forces through disk springs 4 and a guide rod 5, is fitted in insulating disk 2. Electrodes 11 through 16 and resistor elements 21 through 25 are thus held together under pressure.

An impact pin 6, directly coupled to platen 3 to which it transmits a translation motion, is inserted in guide rod 5. A set screw 7, with which disk springs 3 can be pre-tensioned to, for example, between 1 and 5 kN, is also provided.

The right side of FIG. 1 illustrates a large pre-tensioning force, while the left side illustrates a considerably smaller pre-tensioning force. These tensions are preselected according to the currents to be switched. For a given line current, the conducting state current of the thermoelectric switch can be provided as the current to be switched.

In particular, cylindrical switching chamber 10 of the thermoelectric switch illustrated in FIG. 1 can be sized so that it has an inside diameter of 10.6 cm and a height of 6.2 cm, and it accommodates a stack of exactly six electrodes 11 through 16 and five resistor elements 21 through 25, arranged on top of one another in alternating layers. For this design, the outer diameter of disks 21 through 25 made of resistor material (10.5 cm) is almost as great as the inside diameter of the switching chamber, while the diameter of the disk-shaped electrodes 11 through 16 is approximately 8.6 cm. To reach the same total diameter of 10.5 cm, the gap between metallic electrodes 11 through 16 and the cylindrical inside wall of switching chamber 1 is filled with annular insulating material elements 31 through 33. This is shown particularly in FIG. 2, while FIG. 3 illustrates the associated resistor element.

For the dimensions as set forth above, the sparkover path between two adjacent electrodes through the outer edges of resistor disks 21 through 25 is approximately 2 cm. Since the width of the insulating material gap is limited to approximately 0.2 to 0.4 mm, any sparkover arc would correspond to such a high voltage drop as to make sparkover virtually impossible.

Figure 2:
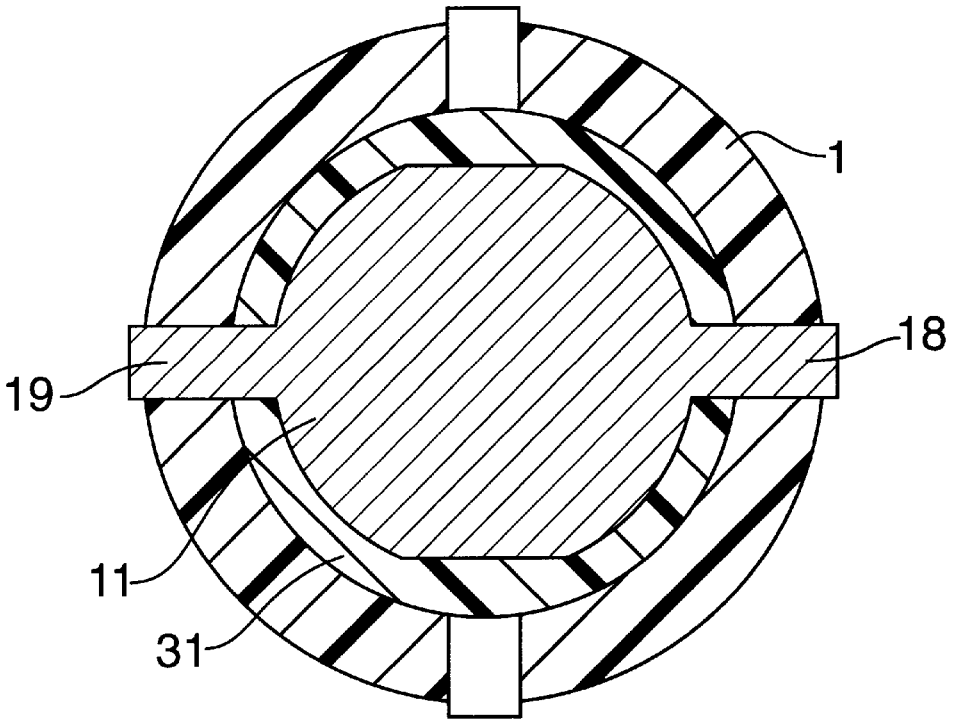
FIG. 2 schematically shows the top view of said switch sectioned along lines II—II of FIG. 1.
Figure 3:
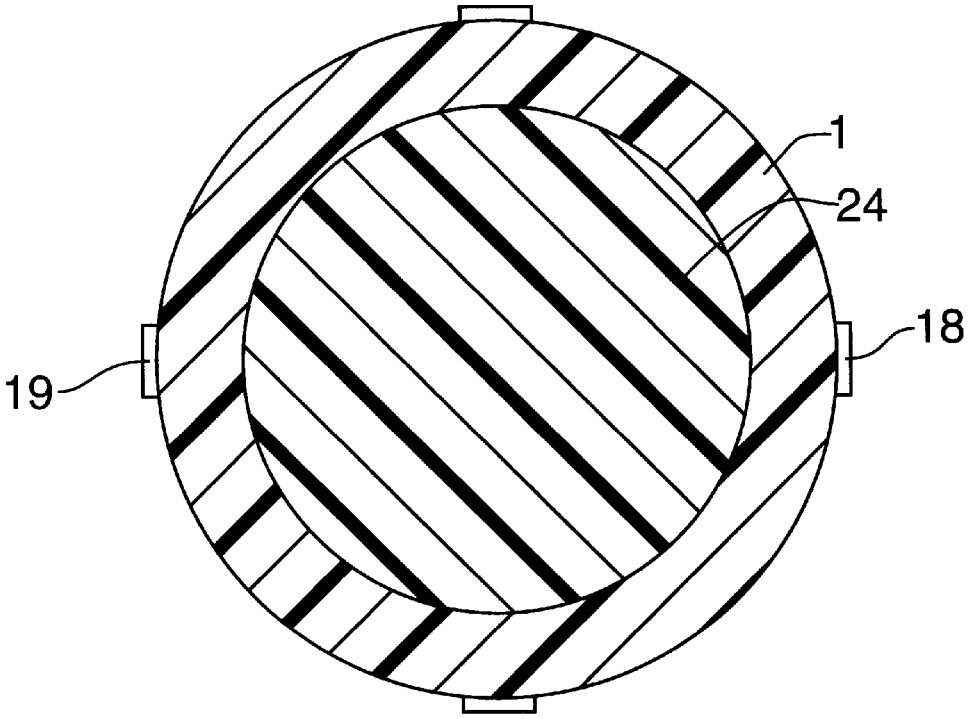
FIG. 3 schematically shows the top view of said switch sectioned along lines III—III of FIG. 1.

FIG. 2 also shows that each individual copper electrode 11 through 16 has electrode connections, for example, connections 18 and 19 in FIG. 2, on opposite sides. To prevent sparkover between electrode connections of adjacent electrodes, the two electrodes assigned to the same resistor disk are rotated 90° in relation to one another. Electrodes of the same potential are electrically connected to the common electrical connection via elastic connecting pieces, which are not illustrated in the figures.

If a switch as described above is connected into a low-voltage line with high short-circuit currents, the uniformly distributed pressure forces that build up in the case of a short-circuit shutoff on electrodes 11 through 16 and resistor disks 21 through 25 are taken up by switching chamber 10, insulating disk 2, and platen 3, which ensures the mechanical stability of the entire structure. Disk springs 4 for producing the pressure force allow an approximately 8 mm elastic path when pre-tensioned to 5 k/N.

Since impact pin 6 is in non-positive contact with platen 3, the mechanical energy produced in the case of a short circuit can be fully transmitted to the outside, for example, to immediately open additional switching contacts that are not illustrated in FIG. 1.

Tests have demonstrated that, in the case of a full short circuit, platen 3 moves to its opening position within a few tenths of a millisecond and moves back to its closing position immediately after the decay of the short-circuit current. Platen 3 is generally not held in its opening position to allow optimum resistance to be formed between the heated resistor disks 21 through 25 and electrodes 11 through 16 under pressure. If necessary, however, platen 3 can be held in the opening position at impact pin 6, without any disadvantage resulting for the electrodes or the resistor bodies.

What is claimed is:

1. A current-limiting switch comprising:

a closed housing comprising an insulating material;

resistor bodies and associated electrode disks, the associated electrode disks acting as electrical contacts, at least one of the electrical contacts being movable, the resistor bodies and associated electrode disks being connected electrically in parallel and each of the resistor bodies and associated electrode disks having respective surfaces, one of the respective surfaces of each of the resistor bodies and associated electrode disks facing one of the respective surfaces of another of the resistor bodies and associated electrode disks within the housing; and a thermoelectric drive, for opening the at least one movable electrical contact when a short circuit current is exceeded, including at least one of the resistor bodies, wherein one of a material of the resistor bodies and a material of contact surfaces of the electrode disks is decomposed and evaporated in order to develop high pressure forces for opening the at least one moveable electrical contact.

2. The switch according to claim 1 wherein the housing forms a cylindrical switching chamber and wherein the electrodes and the resistor bodies are arranged in a stack in alternating layers one on top of another, a number of the resistor bodies being one less than a number of the electrode disks.

3. The switch according to claim 1, further comprising a plurality of annular insulating material elements arranged between the electrode disks and the housing.

4. The switch according to claim 2 wherein the sparkover path between two adjacent electrodes over an outer edge of a resistor body is approximately 50 to 100 times the width of an insulating material gap, thereby preventing voltage sparkovers from occurring.

5. The switch according to claim 1, wherein the electrical contact connections of the associated electrode disks of the resistor bodies are rotated 90° in relation to one another.

6. The switch according to claim 1, wherein the resistor bodies and associated electrode disks are arranged in a stack, further comprising a platen which is arranged on the stack and which is subjected to a predefined pressing force.

7. The switch according to claim 6, wherein the pressing force is produced by at least one disk spring.

8. The switch according to claim 6 further comprising an impact pin, in contact with the platen, for transmitting mechanical energy produced in the case of a short circuit.

9. The switch according to claim 1, wherein the resistor bodies include a polyethylene containing over 50% carbon black.

* * * * *